US006241874B1

(12) United States Patent
Wallace et al.

(10) Patent No.: US 6,241,874 B1
(45) Date of Patent: Jun. 5, 2001

(54) INTEGRATION OF SOLVENT DEASPHALTING AND GASIFICATION

(75) Inventors: Paul S. Wallace, Katy; Kay A. Johnson, Missouri City; Pradeep S. Thacker, Houston; Janice L. Kasbaum, Seabrook; R. Walter Barkley; Jacquelyn Gayle Niccum, both of Houston, all of TX (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/361,953

(22) Filed: Jul. 27, 1999

Related U.S. Application Data

(60) Provisional application No. 60/094,494, filed on Jul. 29, 1998, and provisional application No. 60/103,118, filed on Oct. 5, 1998.

(51) Int. Cl.[7] ..... C10C 11/20

(52) U.S. Cl. ..... 208/45; 208/309; 208/67; 208/106; 208/950

(58) Field of Search ..... 208/309, 67, 106, 208/950, 96, 81, 82

(56) References Cited

U.S. PATENT DOCUMENTS

| | | | | |
|---|---|---|---|---|
| 3,017,250 | | 1/1962 | Watkins et al. | 23/214 |
| 3,617,481 | | 11/1971 | Voorhales et al. | 208/50 |
| 3,951,781 | | 4/1976 | Owen et al. | 208/153 |
| 4,039,429 | | 8/1977 | van Klinken et al. | 208/50 |
| 4,325,812 | | 4/1982 | Fujimori et al. | 208/119 |
| 4,391,701 | | 7/1983 | Le Page et al. | 208/370 |
| 4,405,422 | | 9/1983 | Blomsterberg | 204/129 |
| 4,421,635 | | 12/1983 | Murakami et al. | 208/112 |
| 4,422,960 | | 12/1983 | Shiroto et al. | 502/206 |
| 4,528,088 | | 7/1985 | Chang et al. | 208/6 |
| 4,565,622 | | 1/1986 | Nakako et al. | 208/10 |
| 4,597,773 | | 7/1986 | Quintana et al. | 48/197 |
| 4,609,456 | | 9/1986 | Deschamps et al. | 208/112 |
| 4,750,985 | | 6/1988 | Aldridge et al. | 208/53 |
| 4,795,551 | | 1/1989 | Hamilton et al. | 208/309 |
| 4,938,862 | * | 7/1990 | Visser et al. | 208/67 |
| 5,170,727 | | 12/1992 | Nielsen | 110/346 |
| 5,188,805 | * | 2/1993 | Sabottke | 208/113 |
| 5,466,361 | | 11/1995 | Heck et al. | 208/131 |
| 5,466,363 | | 11/1995 | Audeh et al. | 208/251 |
| 5,911,875 | | 6/1999 | Hervish et al. | 208/309 |

FOREIGN PATENT DOCUMENTS

| | | | |
|---|---|---|---|
| 0 683 218 A2 | 5/1995 | (EP) | C10G/67/04 |
| 1 210 120 | 12/1968 | (NL) | C10G/13/00 |
| WO 99/13024 | 3/1999 | (WO) | C10G/21/00 |

* cited by examiner

*Primary Examiner*—Helane Myers
(74) *Attorney, Agent, or Firm*—Morris N. Reinisch; Howrey Simon Arnold & White

(57) ABSTRACT

The invention is the integration of a process of gasifying asphaltenes in a gasification zone by partial oxidation and the process of asphaltene extraction with a solvent. The integration allows low level heat from the gasification reaction to be utilized in the recovery of solvent that was used to extract asphaltenes from an asphaltene-containing hydrocarbon material. Asphaltenes are extracted from an asphaltene-containing hydrocarbon material by mixing a solvent in quantities sufficient to precipitate at least a fraction of the asphaltenes. The precipitated asphaltenes are then gasified in a gasification zone to synthesis gas. The gasification process is very exothermic. The low level heat in the synthesis gas, either directly, or via an intermediate step of low pressure steam, is used to remove and recover the solvent from the deasphalted hydrocarbon material and from the asphaltenes prior to gasification.

17 Claims, 2 Drawing Sheets

INTEGRATION OF SOLVENT DEASPHALTING AND GASIFICATION

This Application claims the benefit of U.S. Provisional Application 60/094,494 filed Jul. 29, 1998 and U.S. Provisional Application 60/103,118 filed Oct. 5, 1998.

FIELD OF THE INVENTION

The invention relates a process for the extraction and gasification of asphaltenes from oil, heavy oil, or vacuum or distillate residuum. More particularly, the invention relates to the integration of the gasification process and the deasphalting process to utilize what is otherwise waste heat from the gasification process, and to convert the low value asphaltenes to high value synthesis gas.

BACKGROUND OF THE INVENTION

Many crude oils contain significant quantities of asphaltenes. It is desirable to remove the asphaltenes from the oil, because asphaltenes tend to solidify and foul subsequent processing equipment, and because removal of asphaltenes lowers the viscosity of the oil. Solvent extraction of asphaltenes is used to process residual crude that produces Deasphalted Oil (DAO) which is subsequently catalyticly cracked and made into predominantly diesel. The deasphalting process typically involves contacting a heavy oil with a solvent. The solvent is typically an alkane such as, propane to pentanes. The solubility of the solvent in the heavy oil decreases as the temperature increases. A temperature is selected wherein substantially all the paraffinic hydrocarbons go into solution, but where a portion of the resins and the asphaltenes precipitate. Because solubility of the asphaltenes is low in this solvent-oil mixture, the asphaltenes precipitate, and are separated from the oil.

Then high pressure steam or a fired heater is typically used to heat the deasphalted oil-solvent mixture to sufficient temperature. The oil portion then separates from the solvent without having to vaporize the solvent. This reduces energy consumption by about 20 to 30 percent over separating off and recovering the solvent for re-use.

The choice of solvent depends on the quality of the oil. As the molecular weight of the solvent increases, the amount of solvent needed decreases but the selectivity, for example to resins and aromatics, decreases. Propane requires more solvent but also does not extract as much aromatics and resins. Solvent recovery costs are generally greater with lower molecular weight solvents.

The process and advantages of gasifying hydrocarbon material into synthesis gas are generally known in the industry. Hydrocarbon materials that have been gasified include solids, liquids, and mixtures thereof. Gasification involves mixing an oxygen-containing gas at quantities and under conditions sufficient to cause the partial oxidation of the hydrocarbon material into carbon monoxide and hydrogen. The gasification process is very exothermic. Gas temperatures in the gasification reactor are often above 1100° C. (2000° F.). The hot synthesis gas is often quenched with water, and then a portion of the remaining sensible heat in the gas is used to make steam. There is a temperature at which steam generation is no longer feasible. Remaining heat in the gas is then typically released to the atmosphere via fan coolers.

SUMMARY OF THE INVENTION

The invention is the integration of a process of gasifying asphaltenes in a gasification zone by partial oxidation and the process of asphaltene extraction with a solvent. The integration allows low level heat from the gasification reaction to be utilized in the recovery of solvent that was used to extract asphaltenes from an asphaltene-containing hydrocarbon material. Asphaltenes are extracted from an asphaltene-containing hydrocarbon material by mixing a solvent in quantities sufficient to precipitate at least a fraction of the asphaltenes. The precipitated asphaltenes and the parafinnic hydrocarbon material are then separated by any conventional means. It is not necessary to completely separate the parafinnic hydrocarbon material from the precipitated asphaltenes. Minor quantities of the parafinnic hydrocarbon material can be gasified with the asphaltenes. However, it is not desirable to gasify the parafinnic material because it is more valuable as catalytic cracker feedstock.

The precipitated asphaltenes are then gasified in a gasification zone to synthesis gas. The gasification process is very exothermic and the synthesis gas is very hot when leaving the gasification zone. The synthesis gas is often quenched and cooled via heat exchangers, wherein it is advantageous to generate steam. Both high pressure (or high quality) steam and low pressure (or low quality) steam can be generated sequentially. However, as the temperature of the synthesis gas declines, the quality of the steam declines, and there is a temperature where steam production is no longer feasible.

The low level heat in the synthesis gas, either directly, or via an intermediate step of low pressure steam, can be used to remove and recover the solvent from the parafinnic hydrocarbon material, also called deasphalted oil (DAO). The low level heat can also advantageously be used to remove the solvent from the precipitated and separated asphaltenes prior to gasification, especially if the asphaltenes have appreciable deasphalted hydrocarbon material, such as in a slurry.

DETAILED DESCRIPTION OF THE INVENTION

Figure 1:
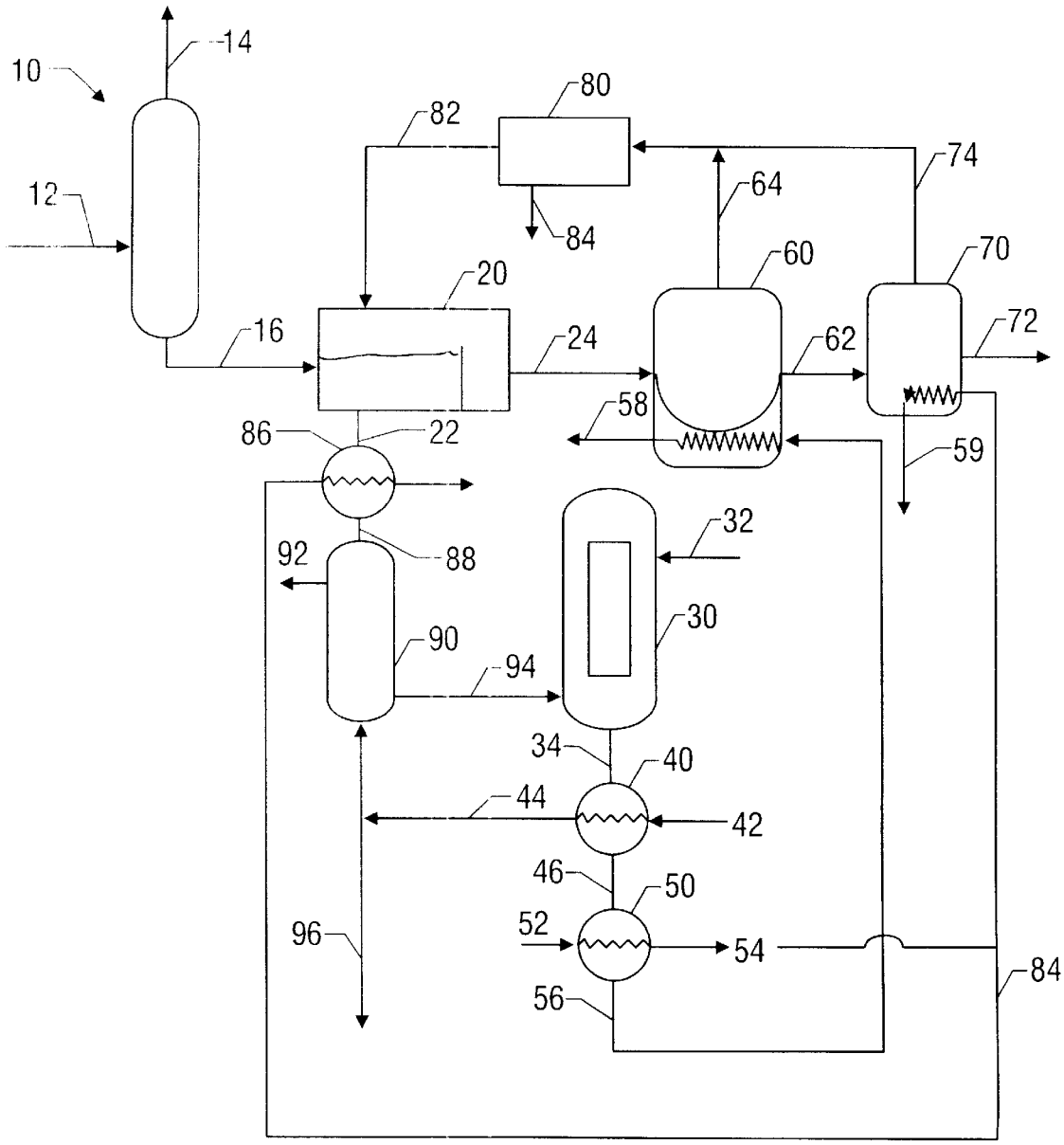
FIGS. 1 and 2 show different embodiments of the invention.

As used herein, the term "precipitate" in the context of precipitating asphaltenes means the asphaltene-rich material forms a second phase, which may be and is preferably a fluid or fluid-like phase. In a preferred embodiment of this invention, the precipitated asphaltene-rich material is pumped to the gasifier. A solid asphaltene-rich phase is not preferred because of handling problems.

As used herein, the term gasification zone refers to the reactor volume in which hydrocarbon access material, particularly asphaltene-rich, is mixed with an oxygen containing gas and is partially combusted.

As used herein, the terms "deasphalted hydrocarbon material", "deasphalted oil", DAO, and "parafinnic oil" are used interchangeably to refer to the oil soluble in the selected deasphalting solvents at the conditions selected for the deasphalting operation.

The invention is the integration of a process of asphaltene extraction with a solvent and a process of gasification by partial oxidation, utilizing the heat produced in the gasification to recover the solvent used in asphaltene extraction. By combining gasification with solvent deasphalting, the often unmarketable by-product asphaltenes can be converted into valuable syngas.

The process is applicable to an asphaltene-containing hydrocarbon material. This material is usually a fluid such as an oil or a heavy oil. During the distillation of crude oil, as employed on a large scale in the refineries for the production of light hydrocarbon oil distillates, a residual oil is often obtained. The process is also applicable for this residual oil. The asphaltene-containing hydrocarbon material may even appear to be a solid, especially at room conditions. The asphaltene-containing hydrocarbon material should be at least partially miscible with the solvent at extraction temperatures.

The extraction of asphaltenes from an asphaltene-containing hydrocarbon material with a low-boiling solvent is known. See, for example, U.S. Pat. No. 4,391,701 and U.S. Pat. No. 3,617,481, the disclosures of which are incorporated herein by reference. The deasphalting step involves contacting the solvent with the asphaltene-containing hydrocarbon material in an asphaltene extractor. It is advantageous to maintain the temperature and pressure such that the asphaltene-containing hydrocarbon material and the low-boiling solvent are fluid or fluid like. Certain additives, including lighter oils, aromatic wash oils, inorganic acids, and the like may be added to improve the efficiency of the deasphalting operation. The contacting may be done in batch mode, as a continuous fluid-fluid countercurrent mode, or by any other method known to the art. The asphaltenes form crystals and can be separated from the deasphalted hydrocarbon material via gravity separation, filtration, centrifugation, or any other method known to the art.

The quality of the deasphalted hydrocarbon material, in terms of metals content and sulfur content, varies inversely with the quantity of asphaltenes and resins separated. For example, removing as asphaltenes 30 weight percent of the oil may result in about a 90 percent reduction in heavy metals. However, removing as asphaltenes 10 weight percent of the oil may result in only about a 60 percent reduction in heavy metals. The quantity of asphaltenes removed and gasified is preferably at least about 20 weight percent, more preferably at least about 30 weight percent, of the asphaltene-containing hydrocarbon material.

The solvent can be any suitable deasphalting solvent. Typical solvents used for deasphalting are light aliphatic hydrocarbons, i.e., compounds having between two and eight carbon atoms. Alkanes, particularly solvents that contain propane, butanes, pentanes, or mixtures thereof, are useful in this invention. The particularly preferred solvents depend on the particular characteristics of the asphaltenes. Heavier solvents are used for higher asphalt Ring and Ball softening point asphaltenes. Solvents may contain a minor fraction, i.e., less than about 20%, of higher boiling alkanes such as hexanes or heptanes.

Most deasphalting solvents are recycled, and therefore generally contain a mixture of light hydrocarbons. Preferred solvents are alkanes having between three and five carbon atoms, i.e., a solvent that contains at least 80 weight percent propane, butanes, pentanes, or mixtures thereof. Because relatively low temperatures are used in the extraction (vaporization) of solvent from the deasphalted hydrocarbon material, the most preferred solvent comprises at least 80 percent by weight of propane and butanes, or at least 80 percent by weight of butanes and pentanes.

Gasification of heavy oils and hydrocarbonaceous solids involves mixing the hydrocarbonaceous material, i.e., the asphaltenes and optionally other hydrocarbonaceous material, with an oxygen-containing gas in a gasification zone, wherein conditions are such that the oxygen and hydrocarbonaceous material react to form synthesis gas. Gasification thereby converts the heavy oil or solid into synthesis gas, or syngas, which is a valuable product. The components of syngas, hydrogen and carbon monoxide, can be recovered for sale or used within a refinery. For example, the syngas can be used as a fuel as a substitute for natural gas, or as a precursor of various chemicals such as methanol.

The use of the sensible heat in the hot synthesis gas to generate steam is also known. See, for example, U.S. Pat. No. 4,597,773, the disclosure of which is incorporated herein by reference. As used herein, the term "sensible heat" is the energy given up by the gas as it is cooled from one temperature to another. Sensible heat includes, therefore, the heat of condensation of components if any components in the gas do in fact condense. The synthesis gas has a large quantity of low quality energy in the form of sensible heat after steam generation. Extraction of heat energy from the synthesis gas to generate high pressure steam can cool the gas to about 260° C. Further generation of low pressure steam can cool the gas to about 170° C. The remaining sensible heat in the syngas is usually discarded to the atmosphere via fan coolers. The integration of deasphalting and gasification provides a profitable way to utilize this energy.

Asphaltenes in oil makes further transportation and processing of the oil difficult. To maximize the value of heavy petroleum oils, separation of the asphalt components in the oil has been practiced for years. The non-asphaltene components are recovered and sold as valuable products leaving the asphaltene component that has very little value. Asphaltenes are a hydrocarbonaceous material suitable for gasification. See, for example, U.S. Pat. No. 4,391,701, the disclosure of which is incorporated herein by reference.

The integration of a solvent deasphalting process and gasification provides the opportunity for particularly beneficial utilization of process heat. The solvent deasphalting process requires a significant amount of heating to recover and recycle the solvent used in the asphalt extraction. The heat is used to strip the solvent from the light oil and the asphalt streams so that it can be recovered and returned to the process. In conventional deasphalters a fired heater or high pressure steam from a boiler is typically used to produce the heat necessary for the deasphalting process. When the process heat available from the gasifier is used to heat the solvent deasphalter streams, the capital and operating cost of solvent deasphalting is reduced. The requirement for extreme heat is reduced, and little fuel is consumed to heat the process streams.

The gasification process is exothermic. The sensible heat can be used to generate high (greater than 600 psi or 4140 KPa) and low pressure steam (100–200 psi, or about 700–1380 KPa). Applicants have found that by utilizing the energy recoverable from low pressure steam and from syngas after steam generation to recover the solvent from the deasphalted hydrocarbon material, the sensible heat in the synthesis gas is efficiently utilized rather than wasted via fan coolers. The syngas after generating high quality, or high pressure, steam is at a temperature of above about 260° C. This heat can be used directly to separate solvent from deasphalted hydrocarbon material. Further generation of low pressure steam can cool the gas to about 170° C. The sensible heat in the synthesis gas after generating low quality steam is used to supply heat to separate solvent from the deasphalted hydrocarbon material. The low quality steam may be advantageously used to complete the removal and recovery of the solvent.

The solvent and deasphalted hydrocarbon material mixture may also be pressurized downstream of the asphaltene extraction allows sufficient driving force for multi-effect evaporation. The flashes may be carried out at various temperatures, and low level energy is advantageously added in at least stage of evaporation.

The solvent deasphalting technology developed as part of this invention is different from other technologies that are commercially available. In the integrated solvent deasphalter and gasification process, the deasphalter maximizes the use of low level heat from synthesis gas instead of using large amounts of high quality steam or fired heaters. The requirement for a fired heater to recover solvent from the DAO is eliminated.

Exposure of the mixture of deasphalted hydrocarbon material and solvent to lower quality heat, as from the syngas after generation of low quality steam, and sometimes advantageously to the low pressure steam or the synthesis gas after generation of high pressure steam, is adequate to separate most of the solvent from the deasphalted hydrocarbon material. The separation step, which involves vaporizing, separating, and recovering the solvent as opposed to higher temperature supercritical crystallization and phase separation, may utilize a vacuum. More typically, however, steam will be used to extract and remove solvent, thereby efficiently stripping residual solvent.

Low level energy from gasification is also beneficially used to preheat the feed to the deasphalted oil stripper and the asphalt stripper. The preheating with process heat generated in the gasification unit minimizes the amount fired heater duty and/or high pressure steam required to achieve the solvent separation.

The total heat utilized may be between about 20 to about 40 percent greater than conventional separation utilizing high pressure steam or a firebox and supercritical extraction. However, significant process improvements result because this low quality heat was waste heat, and because the utilization of this heat often removes the need to utilize at least one fan cooler.

The process heat generated in the gasifier which is typically sent to an airfan cooler is used to heat process streams in the deasphalter, that is, feed streams, the deasphalter itself, and product streams. The utilization of the gasifier's low level heat therefore decreases the cost of the gasifier, because eliminated airfan coolers reduce the capital cost and the operating cost of the gasifier. The efficiency of the gasifier is also increased because the lower level energy is captured and used in the deasphalter.

In the solvent deasphalting process the deasphalted hydrocarbon material separated from the asphaltene-containing hydrocarbon material by liquid-liquid extraction is valuable catalytic cracker feedstock. The separated asphaltene-rich material, on the other hand, is much less valuable and is therefore ideal gasification feedstock. The more catalytic cracker feed that is separated from the asphaltene-containing hydrocarbon material by liquid-liquid extraction the more viscous the asphaltenes become. In the past, the yield of the deasphalter was reduced in order to leave sufficient oil in the asphaltene-rich material so that the asphaltene-rich material was pumpable. Reducing the yield of valuable catalytic cracker feedstock to maintain asphaltene viscosity reduced the profitability of the unit.

Maintaining the asphaltenes as a pumpable fluid or slurry in deasphalted hydrocarbon material will ease handling problems normally associated with asphaltenes. However, it is usually advantageous to separate and recover the solvent from the process feed. It is also advantageous in most situations to minimize the quantity of deasphalted hydrocarbon material that is sent to the gasifier, i.e., at least about 90 weight percent of the deasphalted hydrocarbon material is preferably separated from the precipitated asphaltenes stream.

In one embodiment of this invention the asphaltene-rich material is pumped directly from the bottom of the solvent stripper to the gasifier. The asphaltene-rich material in the bottom of the stripper is hot, i.e., from about 170° C. to about 260° C., and the viscosity of this material is reduced at high temperature. Therefore, extremely heavy asphaltene-rich material produced from high yield operations, wherein a very high percentage of the valuable catalytic cracker feedstock is separated, can still be pumped. Maintaining this gasifier feedstock as a pumpable fluid is highly advantageous.

In this embodiment, the bottoms from the deasphalter, containing asphaltene-rich material, some residual solvent, and a small quantity of residual parafinnic oil are heated before the stream is routed to the solvent stripper. The asphaltenes can be heated more effectively while the solvent is still present. The thermal conductivity of asphaltenes is low, and the viscosity of the asphaltenes does not in many cases allow for effective mixing. The solvent absorbs heat much more readily. With solvent present, the viscosity of the asphaltene-rich material is lower. This allows for more effective distribution of heat through the asphaltene-rich material. Therefore, the mixture of asphaltene-rich material and solvent can be heated more efficiently than the asphaltenes alone.

When the solvent is stripped from the asphaltene-rich material, the asphaltene-rich material in the bottoms stays at a high temperature. Heat may be added during this time to maintain a high temperature. Maintaining the high temperature makes the asphaltene have lower viscosity, and asphaltene-rich material is pumpable. This facilitates transfer of this asphaltene-rich material to the gasifier. The charge pump for the gasification unit is advantageously placed on the bottoms of the stripper.

The gasifier receives a hot pumpable asphaltene-rich feed. The gasifier performance is enhanced by the high temperature of the feed, because the feed atomizes more efficiently. This in turn results in more efficient reaction kinetics.

It is important in this embodiment to maintain the high temperature of the asphaltene-rich material. Heating the asphaltenes after solvent recovery to meet viscosity requirements is very difficult due to the low thermal conductivity of the asphaltenes. Therefore, the lines carrying the asphaltene-rich material to the gasifier are advantageously insulated to minimize cooling of the asphaltene-rich material during transport, and auxiliary heating elements or a line-purge material such as heavy oil may be useful in the event of a process interruption.

The configuration of this embodiment of the invention is also advantageous because the operating inventory of the stripper acts as a feed drum for the gasifier. Asphaltenes cannot be conveniently stored as a fluid. The asphaltene-rich material will become unpumpable and eventually solidify if allowed to cool. For smooth operation of the gasifier, a feed drum is required. The charge drum is used during startup to circulate feed prior to operation, during normal operation to absorb feed rate fluctuations, and during deasphalter shutdown to allow the gasifier to remain operating until an alternate feed can be lined up to the unit.

Other hydrocarbonaceous materials from other sources may be gasified with the asphaltenes. For example, waste hydrocarbons, heavy oils, coal and tars may be gasified with the asphaltenes. If these other materials cannot be mixed with the asphaltene-rich material because the addition of these other materials does not result in a pumpable material, the additional feed would be beneficially injected into the gasifier separately.

The solvent separated from the deasphalted hydrocarbon material stream, and if applicable from the separated or partially separated asphaltene stream, is advantageously recycled and reused to deasphalt more asphaltene-containing hydrocarbon material. It may be necessary to treat the recovered solvent to remove gasoline range hydrocarbons, i.e., compounds containing between 5 and 10 carbon atoms, that are stripped from the deasphalted hydrocarbon material when the solvent is stripped. Said gasoline range hydrocarbons can be mixed with the deasphalted hydrocarbon material to lower the viscosity of that material, or the gasoline range hydrocarbons can be handled as a separate product. The quantity of gasoline range hydrocarbons will often be less than the quantity extracted if higher heat was utilized to separate and recover the solvent. Alternatively, the quantity of said hydrocarbons can be minimized by vacuum distillation of the asphaltene-containing material prior to mixing with the solvent.

There are other processes, such as salt removal, which may be advantageously conducted after admixture with a solvent in view of the viscosity of the heavy oils to which the invention is often applied.

FIG. 1 is a schematic of one embodiment of the invention. Asphaltene-containing hydrocarbon material enters an atmospheric or vacuum separation chamber 10 via line 12. This material may be heated (not shown). Light oils are separated from the asphaltene-containing hydrocarbon material and exit the separation chamber 10 via line 14. The asphaltene-containing hydrocarbon material exits the atmospheric or vacuum separation chamber and enters the asphaltene extractor 20 via line 16. A solvent enters the asphaltene extractor (20) from the solvent condenser (80) via line 82. Asphaltenes and some deasphalted hydrocarbon material exit the asphaltene extractor (20) via line 22. This stream in line 22 is heated and the solvent recovered as described. The asphaltene-rich material is preheated in heat exchanger 86 and then travels via line 88 to a solvent stripper. In this embodiment low pressure steam from line 84 is used as the heat source. Alternatively, high pressure steam, synthesis gas, or a series of heat exchangers, may be used. The hot asphaltene-rich material travels via line 88 to solvent stripper 90. In this embodiment high pressure steam from line 44, generated by cooling synthesis gas, is used to strip the solvent. This may not use all of the high pressure steam, and line 96 simply represents withdrawing some steam for other uses, such as stripping the solvent from the parafinnic oil. The hot asphaltenes are pumped through line 94 to the gasifier 30. The stream in line 94 enters the gasification zone 30, where it is mixed with an oxygen-containing gas introduced via line 32. The partial oxidation that occurs in the gasification zone 30 results in a very hot synthesis gas that exits the gasification zone via line 34. A water quench system that partially cools the gas and removes particulates is not shown. The hot synthesis gas passes though a heat exchanger 40 wherein water in line 42 is converted to high quality steam in line 44. This steam is a product used either within the deasphalting process or elsewhere. The synthesis gas then exits the heat exchanger 40 via line 46 and enters a second heat exchanger 50. The hot synthesis gas passes though a heat exchanger 50 wherein water in line 52 is converted to low quality steam in line 54. The synthesis gas then exits heat exchanger 50. The sensible heat remaining in the syngas may provide additional low level heat as needed in the process. One example is to route the synthesis gas to a heat exchanger associated with separation column 60. The syngas is used for process heat only. It is not mixed with the deasphalted oil, the solvent or the asphaltenes. Deasphalted hydrocarbon material, also called parafinnic and, from the asphaltene extractor 20 also enters the separation column 60 via line 24. The material is heated via a heat exchanger, using hot synthesis gas, steam, or both as a heat source. Within the separation column 60 the deasphalted hydrocarbon material and solvents are separated and the solvent that are vaporized leave via line 64. The deasphalted hydrocarbon material exits separation column 60 via line 62 to a second separation column 70. Low quality steam from line 54 is used to heat the deasphalted hydrocarbon material in the separation column 70 and may be use to strip solvent from the deasphalted hydrocarbon material. Solvents that are vaporized leave via line 74. The deasphalted hydrocarbon material leaves via line 72 and is a product used elsewhere, for example, as feedstock term catalytic cracker. Solvent vapors in lines 64 and 74 enter the solvent condensor/pump/separator 80 wherein the solvent vapor is changed into a pressurized liquid. The solvent exits the solvent condensor/pump 80 via line 82 and enters the asphaltene extractor 20. Separated water is removed via line 84.

Figure 2:
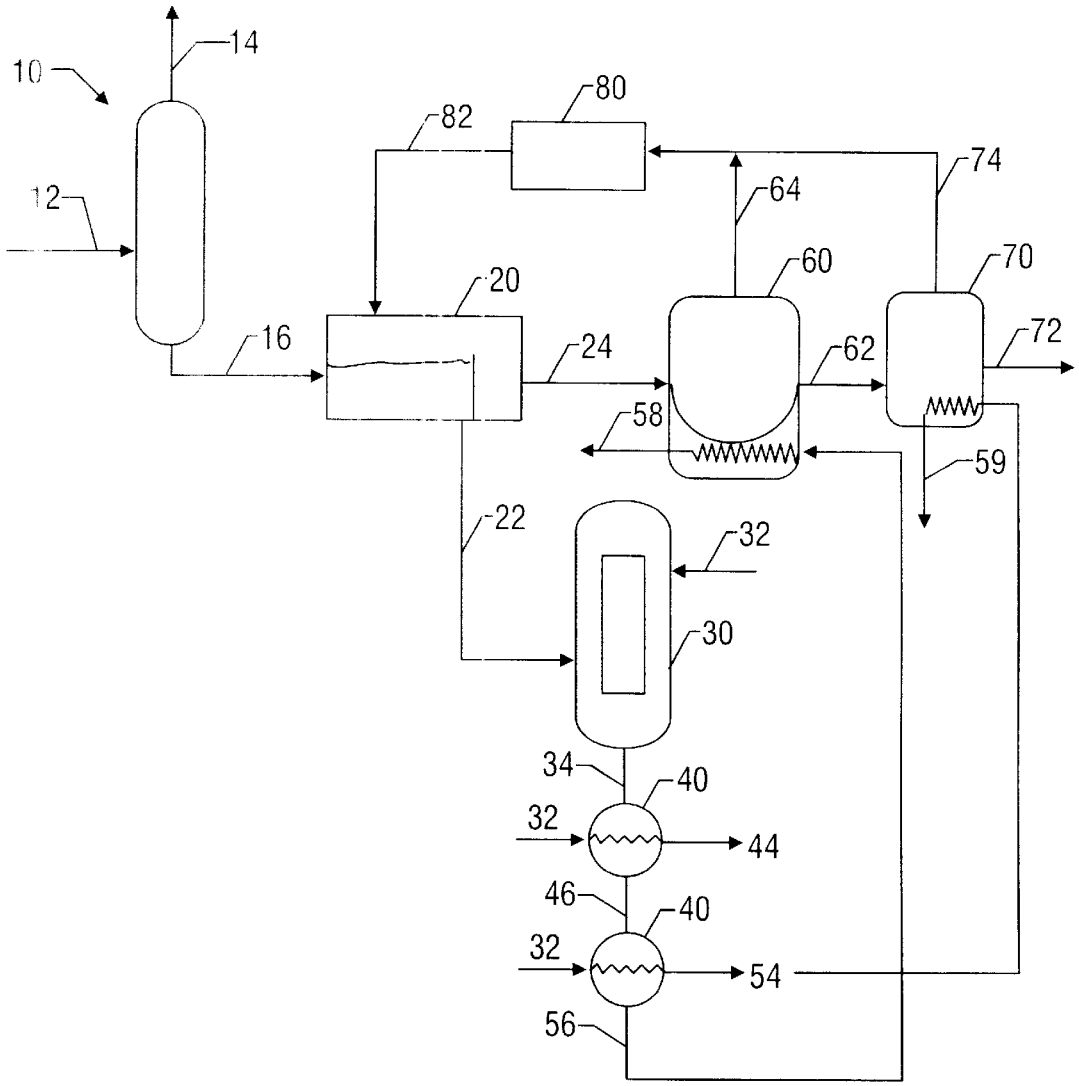

FIG. 2 is another embodiment of the invention. Asphaltene-containing hydrocarbon material enters a vacuum separation chamber (10) via line 12. Light oils are separated from the asphaltene-containing hydrocarbon material and exit the vacuum separation chamber (10) via line 14. The asphaltene-containing hydrocarbon material exits the vacuum separation chamber and enters the asphaltene extractor (20) via line 16. A solvent enters the the asphaltene extractor (20) from the solvent condenser (80) via line 82. Asphaltenes and some deasphalted hydrocarbon material exit the asphaltene extractor (20) via line 22. Optionally, this stream in line 22 can be separated to recover solvent, but this step is not shown in the drawing. The stream in line 22 enters the gasification zone (30), where it is mixed with an oxygen-containing gas introduced via line 32. The partial oxidation that occurs in the gasification zone (30) results in a very hot synthesis gas that exits the gasification zone via line 34. A water quench system that partially cools the gas and removes particulates is not shown. The hot synthesis gas passes though a heat exchanger (40) wherein water in line 42 is converted to high quality steam in line 44. This steam is a product used elsewhere. The synthesis gas then exits the heat exchanger (40) via line 46 and enters a second heat exchanger (50). The hot synthesis gas passes though a heat exchanger (50) wherein water in line 52 is converted to low quality steam in line 54. The synthesis gas then exits heat exchanger (50) and is sent to the separation column (60). Deasphalted hydrocarbon material from the asphaltene extractor (20) also enters the separation column (60) via line 24. Within the separation column (60) the deasphalted hydrocarbon material is heated and solvents that are vaporized leave via line 64. The synthesis gas is a product used elsewhere. The deasphalted hydrocarbon material exits separation column (60) via line 62 to a second separation column (70). Low quality steam from line 54 is used to heat the deasphalted hydrocarbon material in the separation column (70). Solvents that are vaporized leave via line 74. The deasphalted hydrocarbon material leaves via line 72 and is a product used elsewhere. Solvent vapors in lines 64 and 74 enter the solvent condensor/pump (80) wherein the solvent is changed into a pressurized liquid. The solvent exits the solvent condensor/pump (80) via line 82 and enters the asphaltene extractor (20).

What is claimed is:

1. A process of gasifying asphaltenes in a gasification zone comprising:

a) mixing a solvent with an asphaltene-containing hydrocarbon material in quantities and under conditions sufficient to precipitate at least a fraction of the asphaltenes, thereby producing a deasphalted hydrocarbon material and precipitated asphaltenes;

b) separating at least a fraction of the deasphalted hydrocarbon material from the precipitated asphaltenes and providing the deasphalted hydrocarbon fraction to a separation column;

c) providing at least part of the precipitated asphaltenes to a gasification zone;

d) gasifying the asphaltenes to form a synthesis gas; and e) separating solvent from the deasphalted hydrocarbon material utilizing sensible heat from the synthesis gas.

2. The process of claim 1 wherein the solvent contains propane, butanes, pentanes, hexanes, heptanes, or mixtures thereof.

3. The process of claim 2 wherein the solvent contains at least 80 weight percent propane, butanes, pentanes, or mixtures thereof.

4. The process of claim 2 wherein the solvent contains at least 80 weight percent propane and butanes.

5. The process of claim 1 further comprising generating steam prior to utilizing remaining sensible heat from the synthesis gas to separate solvent from the deasphalted hydrocarbon material.

6. The process of claim 5 wherein medium pressure and low pressure steam are generated.

7. The process of claim 6 wherein at least a fraction of the low pressure steam is used to separate solvent from the deasphalted hydrocarbon material.

8. The process of claim 1 wherein at least about 20 weight percent of the asphaltene-containing hydrocarbon material is precipitated as asphaltenes.

9. The process of claim 1 wherein in step (b) at least about 90 weight percent of the deasphalted hydrocarbon material is removed from the precipitated asphaltenes.

10. The process of claim 1 further comprising adding other hydrocarbonaceous material to the gasification zone.

11. The process of claim 1 wherein the separation of at least part of the solvent from the deasphalted hydrocarbon material occurs at a vacuum.

12. The process of claim 7 wherein at least a portion of the steam strips solvent from the deasphalted material.

13. The process of claim 1 further comprising utilizing sensible heat from the synthesis gas to separate solvent from the asphaltenes.

14. The process of claim 13 wherein at least a portion of the solvent is removed from the asphaltenes by steam stripping.

15. The process of claim 1 further comprising re-using the solvent separated from the deasphalted hydrocarbon material stream in step (a).

16. The process of claim 13 further comprising re-using the solvent separated from the asphaltenes.

17. The process of claim 13 further comprising heating the precipitated asphaltenes to between about 170° C. to about 260° C. prior to separating solvent from the asphaltenes, and wherein the precipitated asphaltenes are provided to the gasification zone as a pumpable fluid.

* * * * *